US010122124B2

(12) United States Patent
Daughtry, Jr. et al.

(10) Patent No.: US 10,122,124 B2
(45) Date of Patent: Nov. 6, 2018

(54) THREE DIMENSIONAL LEAD-FRAMES FOR REDUCED CROSSTALK

(71) Applicant: Genesis Technology USA, Inc., Norcross, GA (US)

(72) Inventors: Earl Anthony Daughtry, Jr., Lawrenceville, GA (US); Robert Colantuono, Grayson, GA (US)

(73) Assignee: Genesis Technology USA, Inc., Lawrenceville, GA (US)

( * ) Notice: Subject to any disclaimer, the term of this patent is extended or adjusted under 35 U.S.C. 154(b) by 96 days.

(21) Appl. No.: 15/075,429

(22) Filed: Mar. 21, 2016

(65) Prior Publication Data

US 2016/0294121 A1 Oct. 6, 2016

Related U.S. Application Data

(60) Provisional application No. 62/142,291, filed on Apr. 2, 2015.

(51) Int. Cl.
*H01R 13/6585* (2011.01)
*H01R 13/6461* (2011.01)
(Continued)

(52) U.S. Cl.
CPC ..... *H01R 13/6585* (2013.01); *H01R 13/405* (2013.01); *H01R 13/6461* (2013.01); *H01R 43/24* (2013.01); *H01R 24/60* (2013.01)

(58) Field of Classification Search
CPC ..... H01R 13/6585
(Continued)

(56) References Cited

U.S. PATENT DOCUMENTS 4,824,383 A * 4/1989 Lemke ..... H01R 24/60 439/108
6,315,608 B1 * 11/2001 Lopata ..... H01R 13/6585 439/607.36
(Continued)

FOREIGN PATENT DOCUMENTS

CN 101740989 6/2010
CN 102856738 1/2013
(Continued)

OTHER PUBLICATIONS

Translated Chinese Office Action dated Dec. 5, 2017 for Chinese Patent Application No. 201610204370.6, a counterpart foreign application of U.S. Appl. No. 15/075,429, 14 pages.
(Continued)

*Primary Examiner* — Neil Abrams
(74) *Attorney, Agent, or Firm* — Lee & Hayes, PLLC; Charles L. Warner

(57) ABSTRACT

A connector (400), such as a plug or a receptacle, has reduced cross-talk. The connector has a conductive plate (305), first and second insulators (310A, 310B) on either side of the conductive plate, leads (115) outside of the insulators, the leads being formed from first and second lead-frames, at least one of the leads (115, 315) having at least one tab or extension (320) which capacitively or conductively couples the lead to the conductive plate. The plate (305) may include an extension shaft (540), and a lateral extension (320) from a lead may be placed into contact with the shaft. A lateral extension (320E) formed on a rear portion of a lead may be placed into contact with a rear portion of the conductive plate (305B1) or with an opposing lead. Some of the leads may include severable tie bars (705).

19 Claims, 5 Drawing Sheets

(51) Int. Cl.
*H01R 13/405* (2006.01)
*H01R 43/24* (2006.01)
*H01R 24/60* (2011.01)

(58) Field of Classification Search
USPC ..... 439/607, 118, 607.08, 607.11
See application file for complete search history.

(56) References Cited

U.S. PATENT DOCUMENTS 6,899,573 B2 * 5/2005 Saka ..... H01R 43/20 206/717
7,005,728 B1 2/2006 Li
7,670,156 B2 * 3/2010 Chen ..... H01R 13/6485 439/108
7,758,379 B2 * 7/2010 Chen ..... H01R 13/6485 439/607.11
7,819,703 B1 10/2010 Walker et al.
7,980,895 B2 7/2011 Berens et al.
8,109,795 B2 * 2/2012 Lin ..... H01R 13/6461 439/660
8,262,411 B2 * 9/2012 Kondo ..... H01R 13/6658 439/607.01
8,764,488 B2 * 7/2014 Zeng ..... H01R 13/6471 439/108
8,851,927 B2 * 10/2014 Hsu ..... H01R 12/724 439/607.11
8,864,506 B2 * 10/2014 Little ..... H01R 13/658 439/108
8,944,849 B1 * 2/2015 Yang ..... H01R 13/6588 439/607.07
8,968,031 B2 * 3/2015 Simmel ..... H01R 13/659 439/108
9,088,108 B2 * 7/2015 Zhao ..... H01R 13/6581
9,178,319 B2 * 11/2015 Little ..... H01R 13/6585
9,231,356 B1 * 1/2016 Ju ..... H01R 24/78
9,276,365 B2 * 3/2016 Yu ..... H01R 13/6594
9,306,336 B2 * 4/2016 Chang ..... H01R 13/6471
9,312,641 B2 * 4/2016 Wang ..... H01R 13/6585
9,318,856 B2 * 4/2016 MacDougall ..... H01R 13/6581
9,331,433 B2 * 5/2016 Ueda ..... H01R 13/6596
9,337,585 B1 * 5/2016 Yang ..... H01R 13/6583
9,350,121 B2 * 5/2016 Ju ..... H01R 13/6585
9,437,980 B2 * 9/2016 Ueda ..... H01R 12/724
9,450,337 B2 * 9/2016 Kao ..... H01R 13/6461
9,461,412 B2 * 10/2016 Yu ..... H01R 13/6585
9,461,424 B2 * 10/2016 Kao ..... H01R 13/6583
9,466,924 B2 * 10/2016 Lin ..... H01R 13/6585
9,484,676 B2 * 11/2016 Chuang ..... H01R 13/6581
9,484,677 B2 * 11/2016 Guo ..... H01R 13/6585
9,484,679 B2 * 11/2016 Guo ..... H01R 13/6585
9,502,841 B2 * 11/2016 Little ..... H01R 4/023
9,515,405 B2 * 12/2016 Zhao ..... H01R 13/405
9,520,680 B2 * 12/2016 Hsu ..... H01R 13/658
9,525,241 B1 * 12/2016 Su ..... H01R 13/6581
9,525,243 B1 * 12/2016 Yuan ..... H01R 13/6585
9,525,244 B1 * 12/2016 Hsu ..... H01R 13/6585
9,537,263 B2 * 1/2017 Gao ..... H01R 13/6582
9,548,568 B2 * 1/2017 Miyoshi ..... H01R 13/428
9,553,391 B2 * 1/2017 Ono ..... H01R 12/712
9,564,716 B2 * 2/2017 Kao ..... H01R 13/6586
9,595,796 B2 * 3/2017 Yen ..... H01R 13/6581
9,608,391 B2 * 3/2017 Little ..... H01R 24/60
9,634,437 B2 * 4/2017 Kao ..... H01R 13/6596
9,640,923 B2 * 5/2017 Kao ..... H01R 12/724
9,647,369 B2 * 5/2017 Tsai ..... H01R 4/02
9,653,849 B2 * 5/2017 Hsu ..... H01R 13/6584
9,673,569 B2 * 6/2017 Zhang ..... H01R 13/6585
9,680,254 B1 * 6/2017 Nishikata ..... H01R 13/627
9,705,217 B2 * 7/2017 Ju ..... H01R 12/712
9,705,267 B2 * 7/2017 Cheng ..... H01R 24/60
9,722,342 B2 * 8/2017 Yuan ..... H01R 13/428
9,728,916 B1 * 8/2017 Tsai ..... H01R 24/60
9,742,095 B2 * 8/2017 Tsai ..... H01R 13/502
9,742,121 B2 * 8/2017 Hayashi ..... H01R 13/6585
9,742,125 B2 * 8/2017 Zhao ..... H01R 13/6594
9,748,701 B2 * 8/2017 Tsai ..... H01R 13/6585
9,755,336 B2 * 9/2017 Cheng ..... H01R 12/712
9,755,368 B2 * 9/2017 Cheng ..... H01R 13/6471
9,768,567 B2 * 9/2017 Cheng ..... H01R 24/60
9,780,479 B2 * 10/2017 Guo ..... H01R 13/504
9,825,407 B2 * 11/2017 Wu ..... H01R 13/6581
9,853,393 B2 * 12/2017 Guo ..... H01R 13/5219
9,881,650 B1 * 1/2018 Sotome ..... G11B 33/122
9,887,485 B2 * 2/2018 Lambie ..... H01R 13/5219
9,917,405 B2 * 3/2018 Ju ..... H01R 13/6585
9,923,317 B2 * 3/2018 Yao ..... H01R 24/62
2013/0059461 A1 3/2013 Lee et al.
2015/0118921 A1 4/2015 Vino, IV et al.
2015/0245501 A1 8/2015 Schunk
2015/0295356 A1 * 10/2015 Tziviskos ..... H01R 24/64 439/248
2015/0295362 A1 * 10/2015 Tziviskos ..... H01R 13/6581 439/607.01
2015/0311636 A1 * 10/2015 Chang ..... H01R 13/6471 439/607.28
2015/0333420 A1 11/2015 Davis et al.
2016/0294121 A1 * 10/2016 Daughtry, Jr. ..... H01R 13/405
2016/0322759 A1 * 11/2016 Park ..... H01R 13/6585
2017/0279234 A1 * 9/2017 Tsai ..... H01R 24/60
2017/0294746 A1 * 10/2017 Fang ..... H01R 13/6597
2018/0083391 A1 * 3/2018 Peng ..... H01R 13/658
2018/0115118 A1 * 4/2018 Zhao ..... H01R 13/6585
2018/0145462 A1 * 5/2018 Feng ..... H01R 13/6597
2018/0151987 A1 * 5/2018 Zhao ..... H01R 13/6585

FOREIGN PATENT DOCUMENTS

CN 203445352 2/2014
CN 104009338 8/2014
CN 203859328 8/2014

OTHER PUBLICATIONS

Response to Chinese Office Action with Translated Claims filed Apr. 20, 2018 for Chinese Patent Application No. 201610204370.6, a counterpart foreign application of U.S. Appl. No. 15/075,429, 17 pages.

* cited by examiner

THREE DIMENSIONAL LEAD-FRAMES FOR REDUCED CROSSTALK

CROSS-REFERENCE TO RELATED APPLICATION

This application claims the priority of U.S. Provisional Patent Application No. 62/142,291, filed Apr. 2, 2015, entitled "Three Dimensional Lead-Frames For Reduced Crosstalk," the entire disclosure and contents of which are incorporated herein by reference.

BACKGROUND

The small spacing between conductors in connectors may provide for undesired cross-talk between conductors.

SUMMARY

A connector, such as a plug or a receptacle, which has reduced cross-talk, is described. The connector has a conductive plate, first and second insulators on either side of the conductive plate, leads (wires or conductors) formed from first and second lead-frames, the leads being outside of the insulators, at least one lead having at least one tab or extension which capacitively or conductively couples the lead to the conductive plate.

A method of making a connector, such as a receptacle, which has reduced cross-talk, is also described. A first lead-frame is provided, a first insulating material is placed on the first lead-frame, a conductive plate is placed on the first insulating material, a second insulating material is placed on the conductive plate, and a second lead-frame is placed on the second insulating material. The first lead-frame and the second lead-frame each have a plurality of leads joined by links and at least one lead of the first lead-frame or the second lead-frame has a tab extending laterally therefrom. The tab is formed toward the conductive plate. A least a portion of the first lead-frame, the second lead-frame, the first insulating material, the second insulating material, and the conductive plate may be overmolded, and at least some of the links in the first lead-frame and the links in the second lead-frame are severed.

A lead-frame is described. The lead-frame has a plurality of lead wires. Each lead wire is joined to at least one other lead wire by at least one severable link. At least one lead wire has a tab extending laterally therefrom.

DETAILED DESCRIPTION

Figure 1:
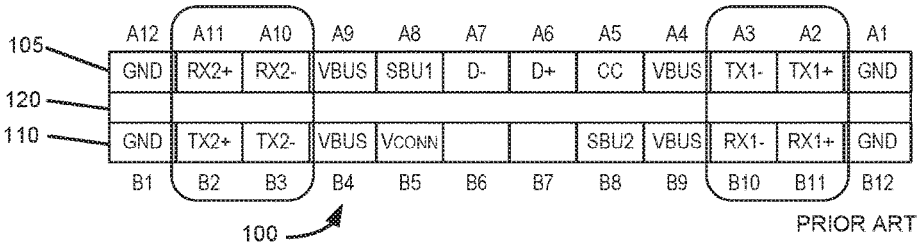
FIG. 1 illustrates the pinout for a typical Universal Serial Bus (USB) 3.1 Type-C connector system.
Figure 5:
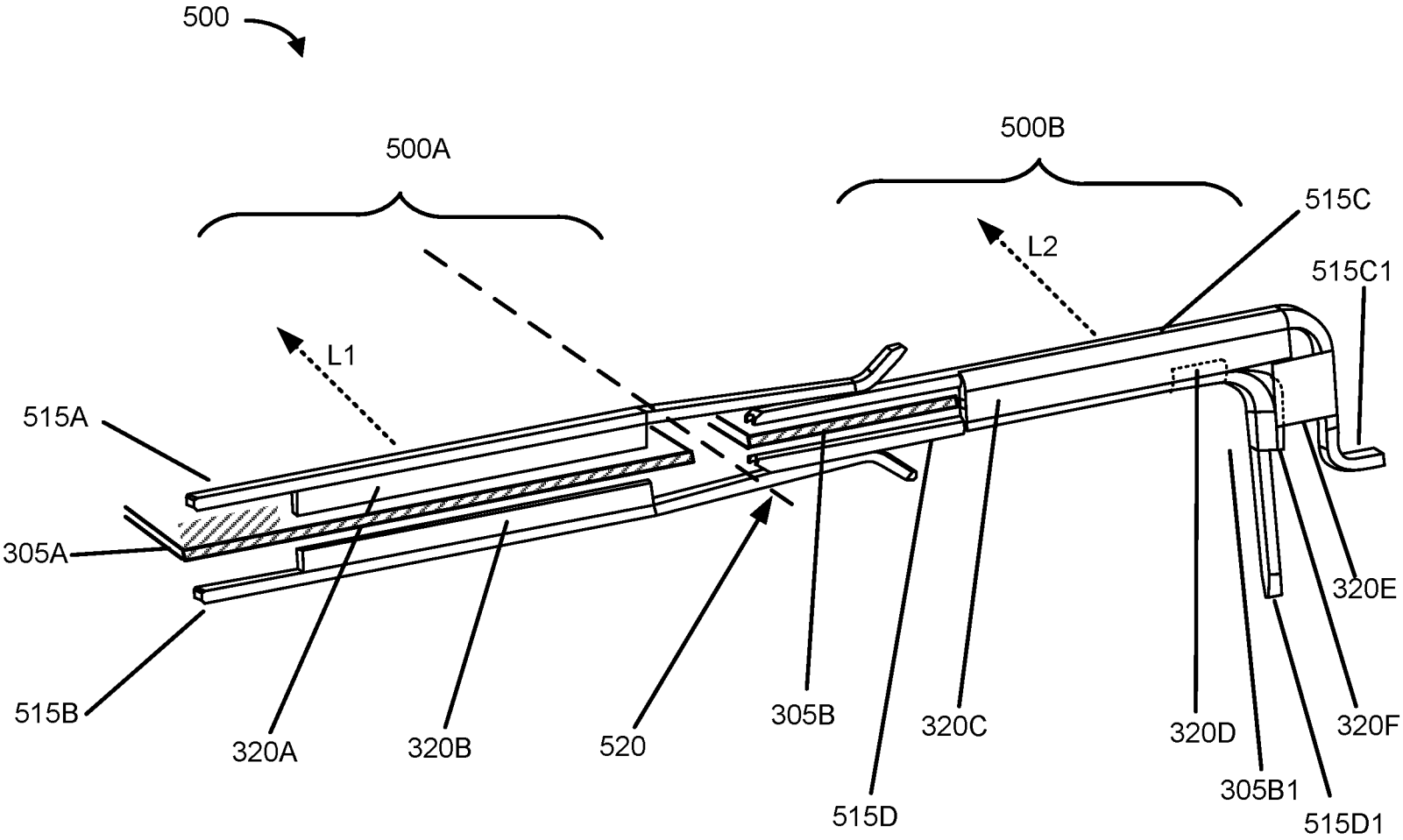
FIG. 5 illustrates a connector system with an exemplary plug and an exemplary receptacle.

FIG. 1 and TABLE 1 illustrate the pinout for a typical Universal Serial Bus (USB) 3.1 Type-C connector system 100. The transmit (TX) and receive (RX) signal pairs are configured in a tandem fashion, i.e., the transmit and receive lines are in rows 105, 110 which are on opposite sides of the connector, separated by an insulating body 120, such as but not limited to a plastic plate, sheet, or film. The transmit lines, such as TX1+ and TX1−, are side-by-side (edge-to-edge) on one row of connector pins, such as the upper row 105, and the receive lines, such as RX1+ and RX1−, are side-by-side on another row of connector pins, such as the lower row 110. Thus, a transmit line, such as TX1+, faces its corresponding receive line, such as RX1+. This forms a dual row 105, 110 connector system, where differential or balanced signals are delivered across a connector boundary, such as a plug-receptacle interface boundary 520 (FIG. 5). The transmit lines are placed in this side-by-side manner and the receive lines are also placed in this side-by-side manner, with a transmit line facing its corresponding receive line. Such a dual row connector system has reduced crosstalk as compared to connector systems where a transmit line is located side-by-side with a receive line in the same row, such as where transmit lines face each other and receive lines face each other.

TABLE I

| PIN | NAME | PIN | NAME |
|---|---|---|---|
| A1 | GND (Ground return) | B12 | GND |
| A2 | TX1+ (SuperSpeed differential pair #1) | B11 | RX1+ |
| A3 | TX1− | B10 | RX1− |
| A4 | VBUS (Bus power) | B9 | VBUS |
| A5 | CC (Configuration channel) | B8 | SBU2 |
| A6 | D+ (USB 2.0 differential pair) | B7 | D− |
| A7 | D− | B6 | D+ |
| A8 | SBU1 (Sideband use) | B5 | VCONN (Configuration channel power) |
| A9 | VBUS | B4 | VBUS |
| A10 | RX2− (SuperSpeed differential pair #2) | B3 | TX2− |
| A11 | RX2+ | B2 | TX2+ |
| A12 | GND | B1 | GND |

Figure 2:
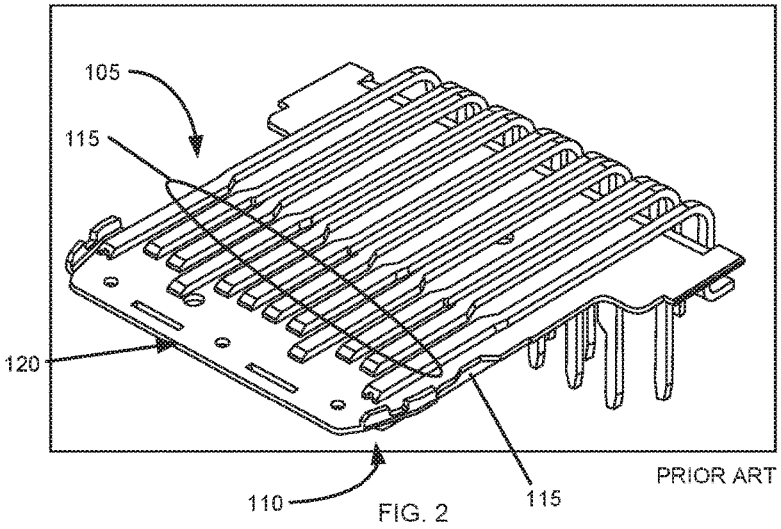
FIG. 2 illustrates a typical USB 3.1 lead-frame receptacle configuration showing leads on the upper row and on the lower row.

FIG. 2 illustrates a typical USB 3.1 lead-frame receptacle configuration showing the leads 115 on the upper row 105 and some of the leads 115 on the lower row 110. The leads (wires, conductors) 115 are produced using a lead-frame, also sometimes referred to as a wire-lead frame. A plastic plate, sheet, or film 120, separates the leads 115 in the upper row 105 from the leads 115 in the lower row 110. There may, however, be capacitive and/or inductive coupling between leads, which may result in an unacceptable level of cross-talk.

Figure 3:
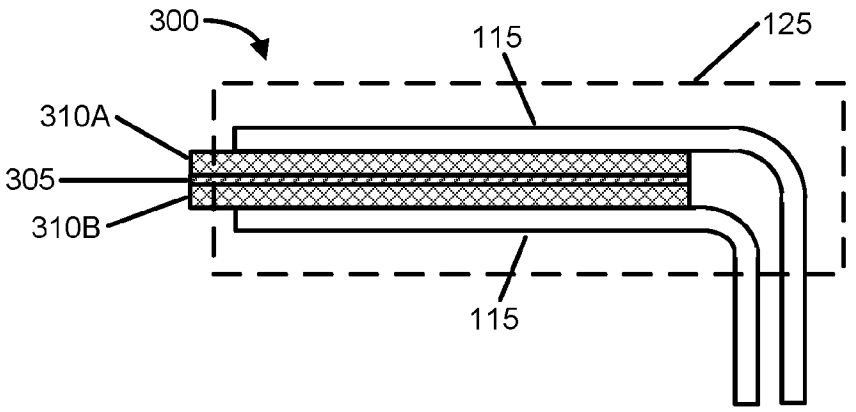
FIG. 3 illustrates an edge view diagram of an exemplary connector with a conductive plate or shield placed between insulating layers of the connector.

FIG. 3 illustrates an edge view diagram of an exemplary connector 300 with a conductive plate or shield 305 between insulating layers (tongues) 310A, 310B of the connector 300, and with the conductive leads 115 (e.g., TX lines, RX lines, VBUS, GND, etc.) being outside the insulating tongues 310A, 310B. The conductive plate 305 further reduces the crosstalk between the conductive leads 115, for example, but not limited to, the crosstalk between the TX1+ and the RX1− leads shown in FIG. 1. There is, however, a limit to how much this conductive plate 305 can reduce the crosstalk, especially if the conductive plate 305 is electrically floating. A connector 300 also typically includes an overmold 125, such as an insulating plastic, which holds the various components in place. For convenience of illustration, an overmold 125 is only shown in FIGS. 3 and 4.

A further reduction of crosstalk may be obtained, as disclosed herein, by use of a modified lead for the RF neutral, power, or ground leads of the connector 300, so as to provide an RF ground (and possibly an electrical ground) for the conductive plate 305. One method of grounding the conductive plate 305 is to connect it to a signal or radio frequency (RF) neutral pin, such as a ground pin (e.g., GND) or a power pin (e.g., VBUS, VCONN).

Figure 4:
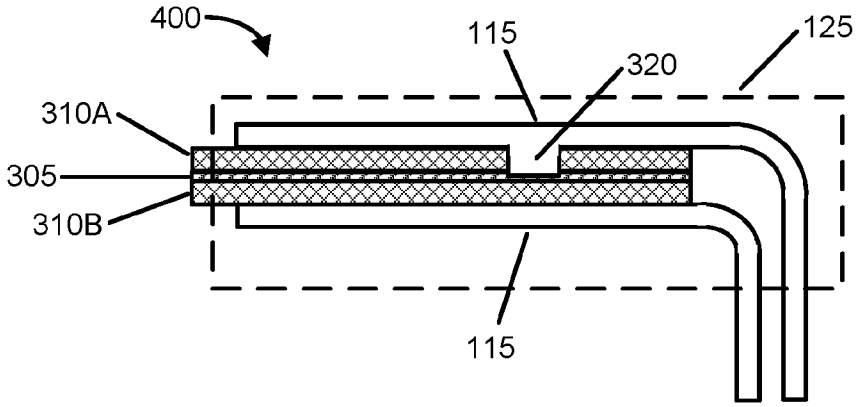
FIG. 4 illustrates an edge view diagram of an exemplary connector with the conductive plate being grounded.

FIG. 4 illustrates an edge view diagram of an exemplary connector 400 with the conductive plate 305 being grounded. A modified lead 115 has a lateral extension 320 which is then "folded" or "rolled", which creates a "three-dimensional" lead. The lateral extension 320 may be a wing, a tab, or other protrusion or component off the side of the lead 115. A lead-frame, and a lead 115 thereof, may be considered to be a two-dimensional (e.g., flat) object having a length and a width because the third dimension, i.e., the height (thickness) of a lead, is typically much smaller than the width of the lead or the length of the lead. The tab 320, however, once folded or rolled, extends significantly into this third dimension, so the modified lead 115 now may be considered to have three dimensions—length, width, and now, resulting from the tab 320, a height.

This folded or rolled tab or extension component 320 provides an RF ground, and possibly an electrical ground, for the conductive plate 305. Preferably, but not necessarily, the modification is applied to an outer lead 115 (that is, one of the GND leads). This modification can be, and preferably is, applied to both a lead in the receptacle and a lead in the plug of a connection system. The modification may be applied to any lead which provides an RF ground, such as, for example, the VBUS lead and the VCONN lead, which are internal leads. Use of such extensions 320 on such internal leads 115 may be less desirable, however, as this may involve compressing or even perforating an insulator 310A or 310B to provide the desired connection between the lead 115 and the conductive plate 305.

A lead 115, preferably but not necessarily, an outer lead, such as any of pins A1, A12, B1, or B12 of FIG. 1, is modified to a three dimensional form forming it with a lateral extension or tab 320, and then by folding or rolling the lateral extension 320 in the direction toward the conductive plate 305. Addition of a lateral extension 320 of a lead 115 is applied to at least one of, and preferably to both of, the receptacle and the plug of the connection system. The tab 320 may be, and preferably is, in direct physical and electrical contact (conductive coupling) with the conductive plate 305. The lateral extension 320 may, however, be placed extremely close to the conductive plate 305 so as to provide a low impedance RF path between the plate 305 and the tab 320 of the lead 115. That is, the conductive plate 305 and the tab 320 may be capacitively coupled due to the minimal thickness and/or dielectric characteristics of the insulating material (e.g., 310A, 310B and/or air) separating the plate 305 and the tab 320. "Capacitively coupled", as used herein, means that the impedance between the conductive plate 305 and the lead with the extension 320 will be sufficiently small at the RF frequencies of interest that the conductive plate 305 is effectively connected to an RF ground and reduces crosstalk to the desired extent.

FIG. 5 illustrates a connector system 500 with an exemplary plug 500A and an exemplary receptacle 500B, and an exaggerated connector boundary 520 therebetween. The term "connector" includes both a plug 500A and a receptacle 500B unless the context requires otherwise. For convenience of illustration only a single set of leads 515A-515D is shown, but arrows L1 and L2 indicate that the connector has multiple parallel leads. The contact portion of the leads in the receptacle 500B fit into the spaced-apart contact portions of the leads in the plug 500A. The plug 500A has modified leads 515A and 515B, and the receptacle 500B has modified leads 515C and 515D. The conductive plates 305A and 305B are also partially shown but, for ease and clarity of illustration, the insulating layers 310A, 310B are not shown. The conductive plates 305A and 305B preferably, but not necessarily, do not extend so far forward that they can make contact with each other when the plug 500A and the receptacle 500B are fully engaged. This is to prevent an accidental short circuit in the event that the manufacturer of the plug 500A has chosen to directly connect the conductive plate 305A to VBUS or VCONN and the manufacturer of the receptacle 500B has chosen to directly connect the conductive plate 305B to GND.

One or more of the leads 515, such as, and preferably, a GND lead, may be manufactured with, and have one or more, lateral extensions 320A, 320B which form tabs or edges directed toward the conductive plate 305, or later bent or turned toward the conductive plate 305. A lateral extension 320 may be placed extremely close to, but not touching, the plate 305 (capacitive coupling), or the lateral extension 320 may make direct contact with a plate 305 (conductive coupling). This particular lateral extension type (tab or edge) is only shown on the plug 500A but is preferably present on the receptacle 500B as well.

Conductive plate 305B preferably has a shielding base section or shielding wall 305B1 (best seen in FIG. 6) which extends between and along the two rows of leads, e.g., the row represented by lead 515C1, and the row represented by lead 515D1.

One or more of the leads 515, such as, and preferably, a GND lead, may be manufactured with, and have one or more, lateral extensions 320C, 320D, which are then rolled toward the conducting plate 305. The lateral extension 320C, 320D from a lead 515 may contact the opposing lead, such as lateral extension 320C from lead 515C being rolled toward, and contacting, the opposing lead 515D. Or, alternatively, the lateral extension 320C, 320D from a lead 515 may be rolled toward, and contact, the conducting plate 305, such as lateral extension 320D from lead 515D being rolled toward the plate 305, and optionally contacting the lower surface of plate 305 or the edge of plate 305. This particular lateral extension type is only shown on the receptacle 500B but may be present, and is preferably present, on the plug 500A as well.

In addition, one or more of the leads 515, such as, and preferably, a GND lead, may be manufactured with, and have one or more, lateral extensions 320E on the portion 515C1, 515D1, of the lead 515C, 515D, the portion 515C1, 515D1 intended to be affixed to a printed circuit board (not shown), such as by soldering. The lateral extension 320E, 320F is then rolled or turned toward, and may contact, the opposing lead, an opposing lateral extension, or the shielding base section 305B 1. The lateral extension 320E, 320F may also optionally contact the lower surface of plate 305 or the edge of plate 305. This particular lateral extension type is only shown on the receptacle 500B but is preferably also present on the plug 500A as well.

These lateral extensions 320 may either come very close to (but not contact) the plate 305, or they may actually contact the plate 305. Thus, the plate 305 will be either capacitively coupled (close, but not contacting) to at least one RF ground lead, or conductively coupled (contacting, or bonded together) to at least one RF ground lead. Thus, the lateral extension or extensions 320 provide for capacitive or direct RF grounding of the plate 305, and also provide for connecting one or more like leads 115 to each other, such as connecting GND leads together, or connecting VBUS leads together. This allows the plate 305 to further reduce the crosstalk between other leads 115.

A lateral extension 320 may be laser welded or bonded to the shielding base section 305B1 to further reduce the crosstalk by increasing the isolation between leads 115. However, it is not necessary to have this laser welding or bonding to increase the isolation.

These lateral extensions 320 may initially function as internal tie bars in the conductor lead-frame, and then be severed on one side and bent, turned, or rolled toward the plate 305 during assembly of a plug 500A or receptacle 500B.

Figure 6:
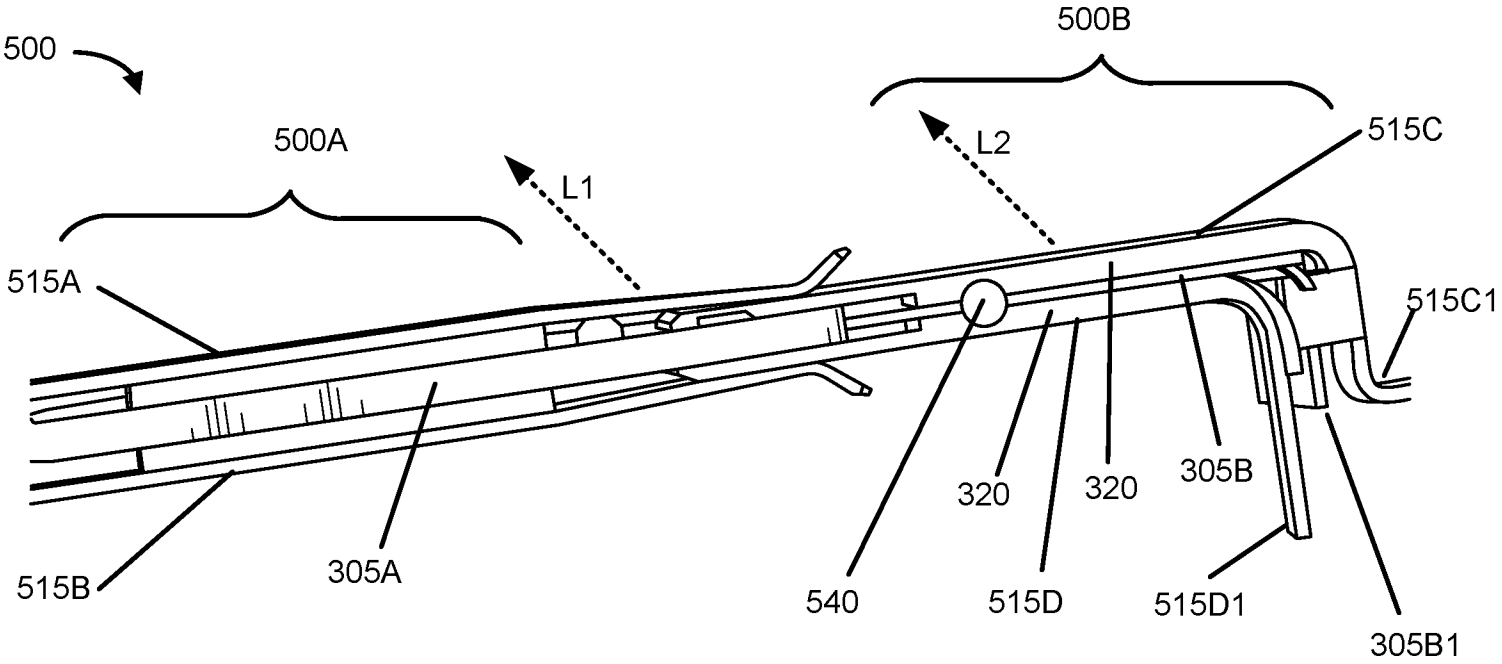
FIG. 6 is an edge view diagram of a connector system having a plate with an extension knob or shaft extending from a side of the plate.

FIG. 6 is an edge view diagram of a connector system 500 having a plate 305B with an extension shaft 540 (which term also includes a knob or other projection) extending from a side of the plate 305B. In that case, the lateral extensions 320 may be simply forced into contact with the shaft 540, may be welded or bonded to the shaft 540, or may have a partial cutout to accommodate the shaft 540. This particular feature is only shown on the receptacle 500B but may also be present on the plug 500A as well. The insulating tongues 310A, 310B are not shown in FIG. 6 for convenience of illustration. For convenience of illustration only a single set of leads 515A-515D is shown, but arrows L1 and L2 indicate that the connector has multiple parallel leads.

Figure 7:
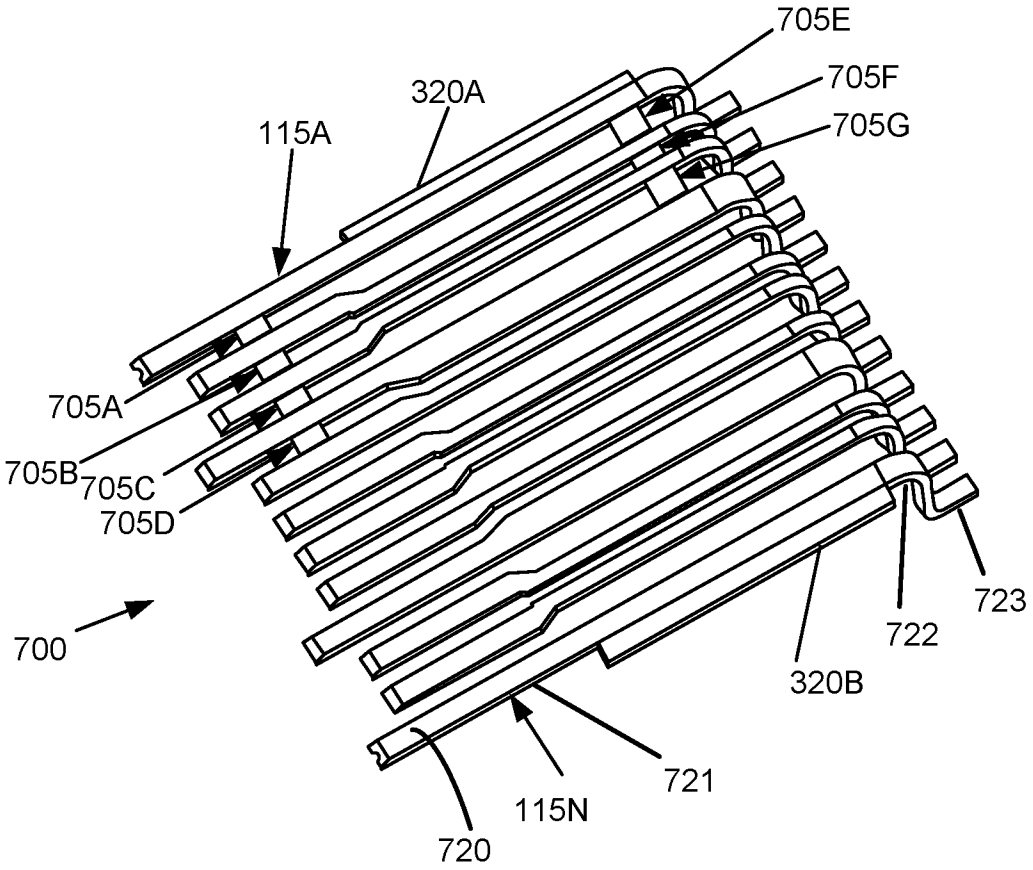
FIG. 7 is an illustration of an exemplary lead-frame with leads and lateral extensions.

FIG. 7 is an illustration of an exemplary lead-frame 700 with leads 115A-115N and lateral extensions 320A, 320B. Also shown are some exemplary internal tie bars 705A-705G, which are later severed, such as by punching, drilling, or laser cutting, to separate the individual leads 115 from each other. Also, if will be appreciated that, in typical production practice, multiple lead-frames 700 will be manufactured, side-by-side, and/or end to end, with some components of one lead-frame initially being connected to components in an adjacent lead-frame, and then the lead-frames are severed from each other to produce the individual wires or leads. For example, the lateral extension 320A of one lead and the lateral extension 320B of an adjacent lead initially may be formed as a single conductor. Then, the lateral extension 320A of one lead is separated from the lateral extension 320B of the adjoining lead, such as by punching, sawing, shearing, or laser cutting. Likewise, the leads 115A-115N of one lead-frame may be initially formed as a single conductor with the leads 115A-115N of another lead-frame, placed end to end. Then, the leads 115A-115N of one wire frame are separated from the leads 115A-115N of the adjacent wire frame, such as by punching, sawing, shearing, or laser cutting.

A lead 115 may be considered to have a contact portion 720 which contacts a corresponding contact portion of a lead 115 on a mating connector, a body portion 721, a corner portion 722, and a pin portion 723 (which may be straight or may be curved or bent) which is to be soldered to, for example, a printed circuit board (not shown).

A connector, such as a plug or a receptacle, may therefore be made, for example, by providing a first lead-frame, for example, lead-frame 700, which has a plurality of leads 115 joined by links 705, placing a first insulating material 310 on the first lead-frame, placing a conductive plate 305 on the first insulating material, placing a second insulating material 310 on the conductive plate 305, placing a second lead-frame 700 on the second insulating material, where at least one lead of the first lead-frame or the second lead-frame has a tab 320 extending laterally from the lead, forming a tab toward the conductive plate so that the tab is in direct or capacitive coupling with the conductive plate, providing an overmold 125 for a least a portion of the first lead-frame, the second lead-frame, the first insulating material, the second insulating material, and the conductive plate, and severing at least some of the links in the first lead-frame and at least some of the links in the second lead-frame.

It will be appreciated from the above that there may be a plurality of various tabs 320A-320F.

The word "exemplary" is used herein to mean serving as an example, instance, or illustration. Any aspect or design described herein as "exemplary" is not necessarily to be construed as preferred or advantageous over other aspects or designs. Similarly, examples are provided herein solely for purposes of clarity and understanding and are not meant to limit the subject innovation or portion thereof in any manner. It is to be appreciated that additional or alternate examples could be presented, but have been omitted for purposes of brevity.

For convenience of discussion herein, when there is more than one of a component, that component may be referred to herein either collectively or singularly by the singular reference numeral unless the context indicates otherwise. For example, components # (plural) or component # (singular) may be used unless a specific component is intended.

The phrases "for example" and "such as" mean "by way of example and not of limitation." The subject matter described herein is provided by way of illustration for the purposes of teaching, suggesting, and describing, and not limiting or restricting. Combinations and alternatives to the illustrated embodiments are contemplated, described herein, and set forth in the claims.

The subject matter described above is provided by way of illustration only and should not be construed as limiting. Furthermore, the claimed subject matter is not limited to implementations that solve any or all disadvantages noted in any part of this disclosure. Various modifications and changes may be made to the subject matter described herein without following the exemplary embodiments and applications illustrated and described, and without departing from the spirit and scope of the following claims.

What has been described above includes examples of aspects of the claimed subject matter. It is, of course, not possible to describe every conceivable combination of components or methodologies for purposes of describing the claimed subject matter, but one of ordinary skill in the art may recognize that many further combinations and permutations of the disclosed subject matter are possible. Accordingly, the disclosed subject matter is intended to embrace all such alterations, modifications and variations that fall within the spirit and scope of the appended claims. Furthermore, to the extent that the terms "includes," "has" or "having" or variations in form thereof are used in either the detailed description or the claims, such terms are intended to be inclusive in a manner similar to the term "comprising" as "comprising" is interpreted when employed as a transitional word in a claim.

The invention claimed is:

1. A receptacle, comprising:

a conductive plate having a first surface and a second surface;

a first lead-frame having a plurality of leads, each lead of the first lead-frame comprising a contact at one end, a body, a corner, and a pin at the other end, the body being between the contact and the corner;

a first insulator interposed between the first surface of the conductive plate and at least a portion of each lead of the plurality of leads of the first lead-frame;

a second lead-frame having a plurality of leads, each lead of the second lead-frame comprising a contact at one end, a body, a corner, and a pin at the other end, the body being between the contact portion and the corner portion;

a second insulator interposed between the second surface of the conductive plate and at least a portion of each lead of the plurality of leads of the second lead-frame;

at least one lead of at least one of the first lead-frame or the second lead-frame further comprising a tab, the tab projecting laterally from the at least one lead and then turning toward the conductive plate, the tab being at least one of: conductively coupled to the conductive plate, or capacitively coupled to the conductive plate; and an overmold covering at least a portion of the first lead-frame, the second lead-frame, the first insulator, the second insulator, and the conductive plate.

2. The receptacle of claim 1 wherein the at least one lead is at least one of: at ground potential, or at radio-frequency ground potential.

3. The receptacle of claim 1 wherein the tab projects directly from the at least one lead toward to the conductive plate.

4. The receptacle of claim 1 wherein the at least one lead is a first lead, and further comprising a second lead of the first lead-frame, the second lead further comprising a second tab, the second tab being at least one of:

conductively coupled to the conductive plate, or capacitively coupled to the conductive plate.

5. The receptacle of claim 1 wherein:

the contact sections of the leads of the first lead-frame are in a first plane and the pin sections of the leads of the first lead-frame are in a second plane, the second plane being approximately perpendicular to the first plane; and the contact sections of the leads of the second lead-frame are in a third plane, the third plane being approximately parallel to the first plane, and the pin sections of the leads of the second lead-frame are in a fourth plane, the fourth plane being approximately perpendicular to the third plane and approximately parallel to the second plane.

6. The receptacle of claim 5 wherein:

the conductive plate has a body section, and a shielding base section;

the body section being in a fifth plane, the fifth plane being between the first plane and the third plane; and the shielding base section being in a sixth plane, the sixth plane being approximately perpendicular to the fifth plane and being between the second plane and the fourth plane.

7. The receptacle of claim 6 wherein the at least one lead further comprises a second tab, the second tab being at least one of:

conductively coupled to the shielding base section, or capacitively coupled to the shielding base section.

8. A method of making a receptacle, the method comprising:

providing a first lead-frame, the first lead-frame comprising a plurality of leads joined by links;

placing a first insulating material on the first lead-frame;

placing a conductive plate on the first insulating material;

placing a second insulating material on the conductive plate;

placing a second lead-frame on the second insulating material, the second lead-frame comprising a plurality of leads joined by links;

at least one lead of the first lead-frame or the second lead-frame has a tab extending laterally therefrom;

forming the tab toward the conductive plate;

overmolding a least a portion of the first lead-frame, the second lead-frame, the first insulating material, the second insulating material, and the conductive plate; and severing at least some of the links in the first lead-frame and the links in the second lead-frame.

9. The method of claim 8 wherein forming the tab comprises bending the tab to contact the conductive plate.

10. The method of claim 8 wherein forming the tab comprises rolling the tab to contact the conductive plate.

11. The method of claim 8:

wherein the conductive plate has a shaft extending from a side thereof; and forming the tab toward the conductive plate comprises forming the tab to contact the shaft.

12. The method of claim 8:

wherein the conductive plate has a first portion in a first plane and a second portion in a second plane, the second plane being approximately perpendicular to the first plane; and wherein the at least one lead comprises a second tab extending from a distal part thereof; and further comprising forming the second tab to contact the second portion of the conductive plate.

13. A receptacle, comprising:

a conductive plate having a first surface, a second surface, and a side, and a shaft extending from the side;

a first lead-frame having a plurality of leads, each lead of the first lead-frame comprising a contact at one end, a body, a corner, and a pin at the other end, the body being between the contact and the corner;

a first insulator interposed between the first surface of the conductive plate and at least a portion of each lead of the plurality of leads of the first lead-frame;

a second lead-frame having a plurality of leads, each lead of the second lead-frame comprising a contact at one end, a body, a corner, and a pin at the other end, the body being between the contact portion and the corner portion;

a second insulator interposed between the second surface of the conductive plate and at least a portion of each lead of the plurality of leads of the second lead-frame;

at least one lead of at least one of the first lead-frame or the second lead-frame further comprising a tab, the tab from the at least one lead contacting the shaft, the tab being at least one of: conductively coupled to the conductive plate, or capacitively coupled to the conductive plate; and an overmold covering at least a portion of the first lead-frame, the second lead-frame, the first insulator, the second insulator, and the conductive plate.

14. The receptacle of claim 13 wherein the at least one lead is at least one of: at ground potential, or at radio-frequency ground potential.

15. The receptacle of claim 13 wherein the tab projects directly from the at least one lead toward to the conductive plate.

16. The receptacle of claim 13 wherein the at least one lead is a first lead, and further comprising a second lead of the first lead-frame, the second lead further comprising a second tab, the second tab being at least one of:

conductively coupled to the conductive plate, or capacitively coupled to the conductive plate.

17. The receptacle of claim 13 wherein:

the contact sections of the leads of the first lead-frame are in a first plane and the pin sections of the leads of the first lead-frame are in a second plane, the second plane being approximately perpendicular to the first plane; and the contact sections of the leads of the second lead-frame are in a third plane, the third plane being approximately parallel to the first plane, and the pin sections of the leads of the second lead-frame are in a fourth plane, the fourth plane being approximately perpendicular to the third plane and approximately parallel to the second plane.

18. The receptacle of claim 17 wherein:

the conductive plate has a body section, and a shielding base section;

the body section being in a fifth plane, the fifth plane being between the first plane and the third plane; and the shielding base section being in a sixth plane, the sixth plane being approximately perpendicular to the fifth plane and being between the second plane and the fourth plane.

19. The receptacle of claim 18 wherein the at least one lead further comprises a second tab, the second tab being at least one of:

conductively coupled to the shielding base section, or capacitively coupled to the shielding base section.

* * * * *